US005515987A

United States Patent [19]

Jacques et al.

[11] Patent Number: 5,515,987

[45] Date of Patent: May 14, 1996

[54] FIVE-PIECE CONTAINER HAVING FOLDABLE SIDE PIECES

[75] Inventors: Michel Jacques, St-Damien-de-Buckland; Roch Nolet, St-Joseph-de-Beauce, both of Canada

[73] Assignee: IPL Inc., St-Damien Bellechasse, Canada

[21] Appl. No.: 502,168

[22] Filed: Jul. 13, 1995

[51] Int. Cl.[6] ..... B65D 6/18

[52] U.S. Cl. ..... 220/6; 220/7; 220/343; 220/337

[58] Field of Search ..... 220/6, 7, 4.28, 220/666, 335, 337, 343, 344

[56] References Cited

U.S. PATENT DOCUMENTS

| | | | |
|---|---|---|---|
| 4,062,467 | 12/1977 | Friedrich | 220/7 |
| 4,081,099 | 3/1978 | Shead | 220/6 |
| 4,170,313 | 10/1979 | Caves et al. | 220/7 |
| 4,181,236 | 1/1980 | Prodel | 220/7 |
| 4,300,695 | 11/1981 | Hsu | 220/6 |
| 4,674,647 | 6/1987 | Gyenge et al. | 220/6 |
| 4,776,457 | 10/1988 | Ferraroni | 220/335 |
| 4,781,300 | 11/1988 | Long | 220/7 |
| 4,887,747 | 12/1989 | Ostrowsky et al. | 220/335 |
| 4,960,223 | 10/1990 | Chiang et al. | 220/7 |
| 5,038,953 | 8/1991 | Radar | 220/6 |

*Primary Examiner*—Stephen J. Castellano

*Attorney, Agent, or Firm*—Merchant, Gould, Smith, Edell, Welter & Schmidt

[57] ABSTRACT

A five-piece plastic container for carrying items, such as fruits and vegetables, comprises a bottom piece and four side pieces; each side edge of the bottom piece includes a series of horizontally spaced recessed areas and a horizontally extending integrally formed hinge traversing the recessed area. Each lower edge of the side pieces includes a series of horizontally spaced extensions defining a C-shaped profile which is adapted to be received within a corresponding one of the recessed areas for the assembly of the side pieces to the bottom piece. The profile is configured to enable a snap engagement and disengagement with and from the hinges, allowing the side pieces to be moved between an outward foldback position, an erected position and an inwardly folded position. The disclosure also describes a seven-piece container.

9 Claims, 7 Drawing Sheets

FIVE-PIECE CONTAINER HAVING FOLDABLE SIDE PIECES

FIELD OF THE INVENTION

The present invention relates to a plastic container for carrying items, such as fruits and vegetables, and, more particularly, to a five-piece container consisting of a bottom piece and four foldable side pieces.

BACKGROUND OF THE INVENTION

Containers for carrying fruits and/or vegetables are now made of plastics material to replace containers which were previously made from wood or cardboard. Plastic containers may be easily cleaned, washed and re-used frequently. They can easily be repaired or recycled.

However, up until now, plastic containers have included, in some cases, fourteen components, some of which are metallic, such as the rods which act as hinges for the folding of the side walls onto the bottom wall. Therefore, if a container needs to be washed, the metallic components must be removed in order to avoid rust. Such containers are difficult to repair and costly to recycle since the metal components must be separated from the plastic parts.

One plastic container, free of metallic components, may be found described in U.S. Pat. No. 5,398,834 issued Mar. 21, 1995 to Umiker. However, an unfolded position of the side walls to a horizontal position to the outside is not possible.

OBJECTS AND STATEMENT OF THE INVENTION

It is an object of the present invention to overcome the above problems with present plastic containers; this is achieved by providing a five-piece plastic container which exclude any metallic parts.

It is also an object of the present invention to provide a five-piece plastic container wherein the mounting and dismounting of its components is quickly carried out through a snap engagement and disengagement feature provided along the connecting edges of the individual pieces.

The present invention therefore relates to a five-piece plastic container for carrying items such as fruits and vegetables which comprises:

a bottom piece having four side edges; and four side pieces, each side piece having a lower edge;

each the side edge of the bottom piece including a series of horizontally spaced recessed areas and a horizontally extending integrally formed hinge traversing each the area; each the lower edge of the side pieces including a series of horizontally spaced extensions defining a C-shaped profile; the extensions being so disposed along each the lower edge as to be received within a corresponding one of the recessed areas for assembly of the side piece to the bottom piece; the profiles being configured to enable a snap engagement and disengagement of the extensions with and from the hinges and to allow the side pieces to be moved between an outward foldback position, an erected position and an inwardly folded position.

The present invention also pertains to a seven-piece container wherein two side pieces are each provided with an additional foldable section that defines a lid to cover the container; the connection of the lid piece to the side piece is accomplished in the same manner as the side piece to the bottom piece.

In one preferred form of the invention, the hinges along the edges define a cross section that includes two orthogonal sides and one semi-circular third side to provide an improved hinge connection.

In a further form of the present invention, the C-shape profile has a longitudinal boss on the exterior wall thereof so that it may frictionally contact adjacent parts of the bottom piece during a folding operation in order to assist in the cleaning of the contacted part.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

FIGS. 7 and 8 are schematical representations of a five-piece container having lid portions in a partially folded position and a fully folded position, respectively.

DESCRIPTION OF PREFERRED EMBODIMENTS

Figure 1:
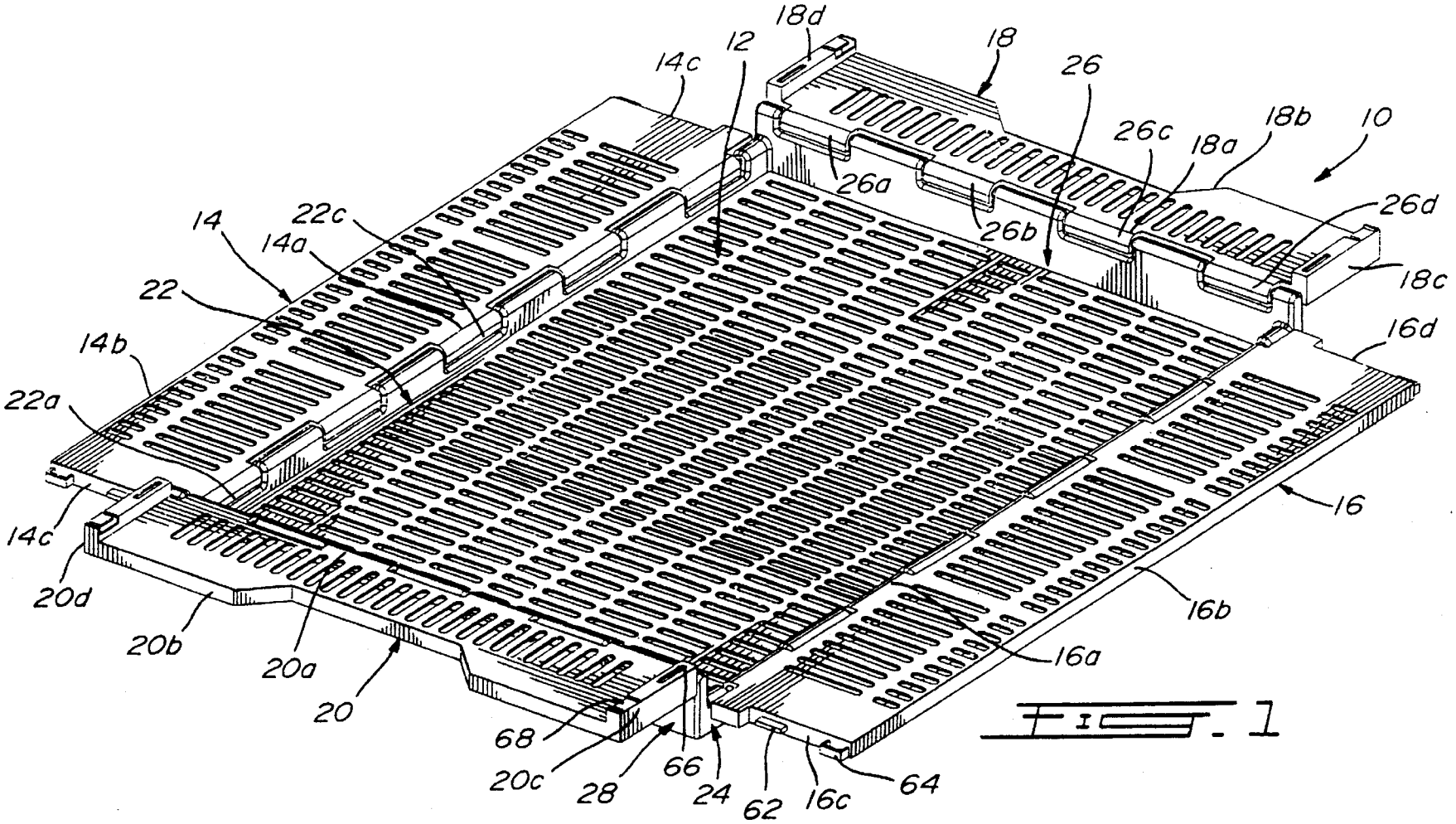
FIG. 1 is a perspective view of a five piece container made in accordance with the present invention shown in the outward foldback position.
Figure 2:
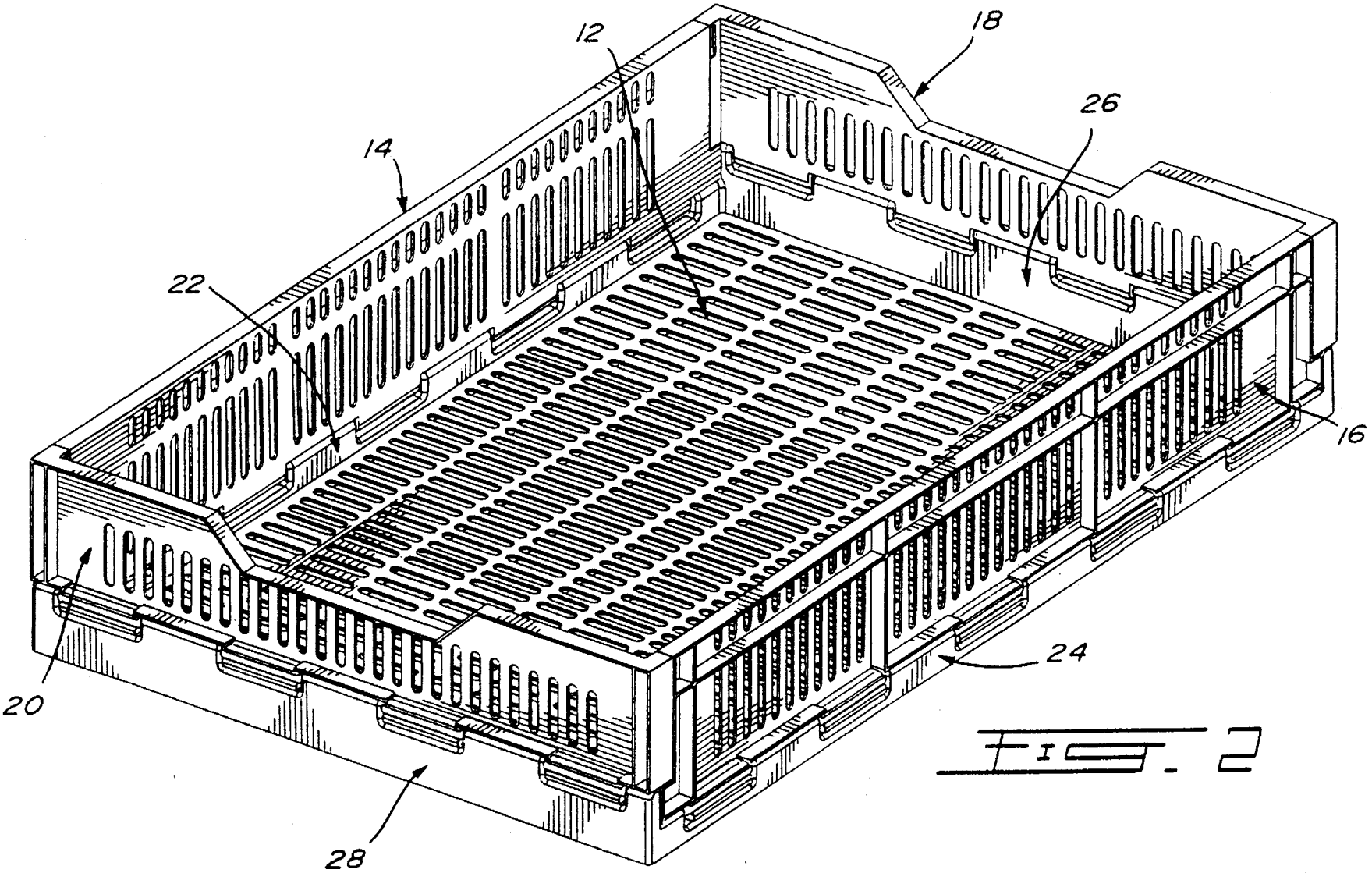
FIG. 2 is a perspective view of the container showing the four side pieces in the erected position.

Referring to FIG. 1, there is shown a five-piece container, generally denoted 10, made entirely and solely of rigid plastics material. The container essentially consists of a bottom piece 12 and of four side pieces 14, 16, 18 and 20. Each of these pieces is provided with a plurality of short and long openings providing aeration to fruits and vegetables, for example, contained in the interior volume of the container when the side pieces are in an erected position such as shown in FIG. 2.

Figure 4:
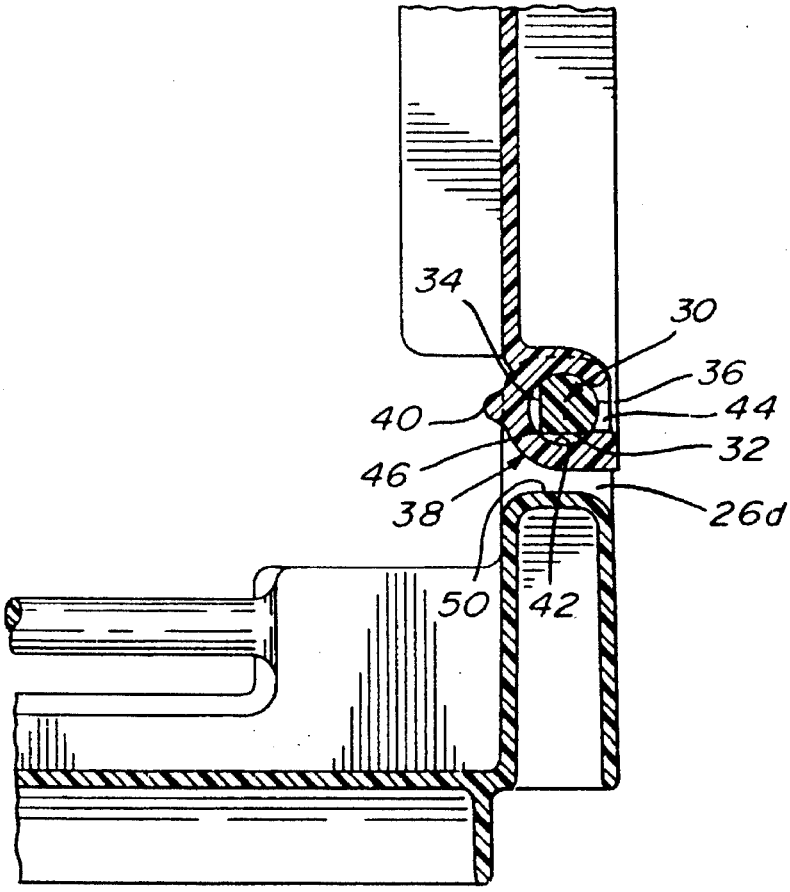
FIGS. 4 and 5 are enlarged cross-sectional views showing the hinge connection in the erected position and in the inwardly folded position, respectively.
Figure 5:
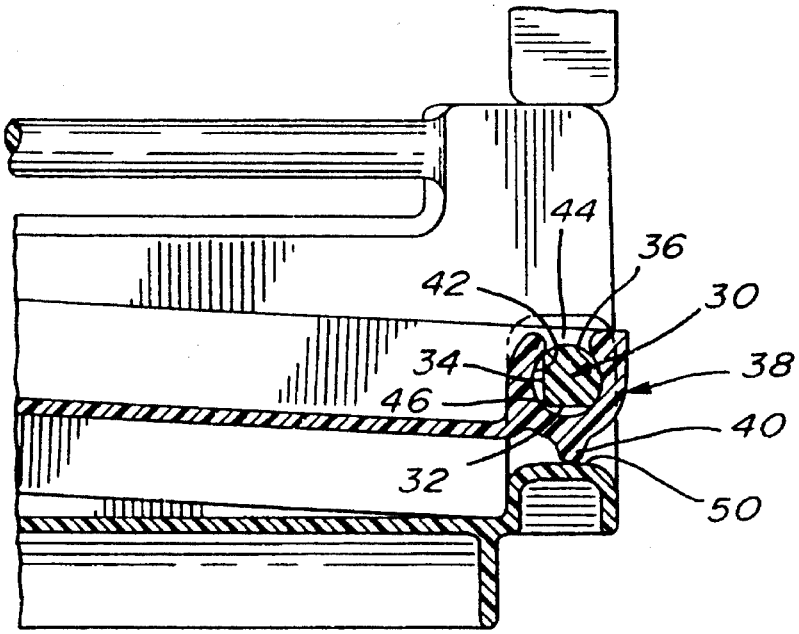

The bottom piece 12 has four upstanding side edges 22, 24, 26 and 28; side edges 22 and 24 have a height which is smaller than that of side edges 26 and 28. Each side edge of the bottom piece 12 includes a series of horizontally spaced recessed areas, four of which have been identified as 26*a*, 26*b*, 26*c* and 26*d* for side edge 26, or as 22*a*, 22*b*, 22*c* and 22*d* for side edge 22. Traversing each recessed area of all four side edges of the bottom piece and integrally formed with the side edge is a hinge 30 (see FIG. 3). As can be seen in FIGS. 4 and 5, the hinge is partly cylindrical as it includes two orthogonal faces 32 and 34 and a third semi-circular face 36.

Each side piece has a lower edge, a top edge and opposite lateral edges which are identified by adding the letters a, b, c and d, respectively, to the reference numeral given to a side piece.

The lower edge of each side piece comprises a series of horizontally spaced tongue-like extensions 38. Each extension defines a C-shaped profile that includes an incomplete cylindrical inner wall 42 leaving a narrow longitudinal opening 44 having a dimension slightly less than the smallest transverse width of the hinge 30. As can be seen in FIG. 4, a portion of the semi-circular face of the hinge will bear against the inner face 42 of the profile when the side piece is in the erected position. Since the container is made of plastic material, that has some resiliency, the engagement of the C-shaped profile onto the hinge is effected through a snap-in motion. Similarly, a snap-out disengagement is carried out in order to remove a side piece from the bottom piece.

The pointed corner edge 46 defined by the two orthogonal faces 32 and 34 of the hinge will scrape the inside surface 42 of the C-profile of the side piece thus providing a self cleaning feature inside the hinge connection. Similarly, a longitudinal boss 40 of the outer wall of the C-profile of the side piece will scrape the top face 50 of each recessed area 26, again to provide a cleaning feature to the container.

Figure 3:
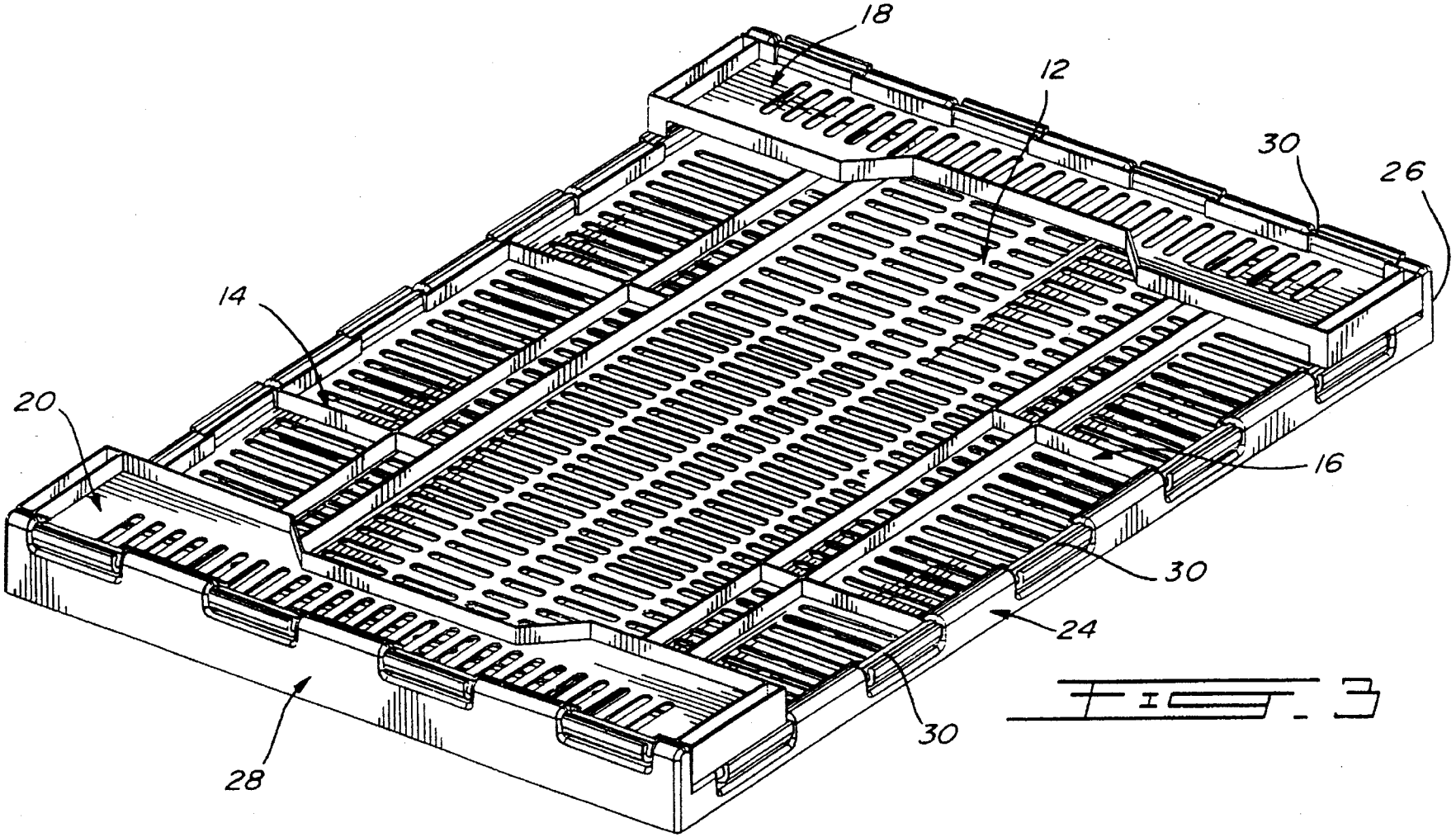
FIG. 3 is a perspective view of the container showing the side pieces in the inwardly folded position.

The particular connection achieved by the C-shaped profile onto the hinges allow the side pieces to move from an outward foldback position, such as shown in FIG. 1, to an erected position, such as shown in FIG. 2 and into an inwardly folded position, such as shown in FIG. 3. Referring to the latter figure, since the height of the bottom edges 26 and 28 is greater than that of the opposite side edges 22 and 24 of the bottom piece, side pieces 14 and 16 will lie in a first plane while side pieces 18 and 20 will lie in a second plane above the first plane.

In order to maintain the side pieces in the erected position shown, each side piece has on its opposite lateral edges (see 16*c*, for example) engaging means which cooperate with complementary engaging means (see 20*c*, for example) on the lateral edge of an adjacent side piece. Referring to FIG. 1, the first engaging means may consist of a block 62 and of a U-shaped member 64, both of which are integrally formed with the side piece. The second engaging means may consist of a longitudinal slot 66 and of a flexible tongue 68. The block 62 is received in the slot 66 while the tongue 68 is flexed during engagement for connection with the U-shaped member 64.

Figure 6:
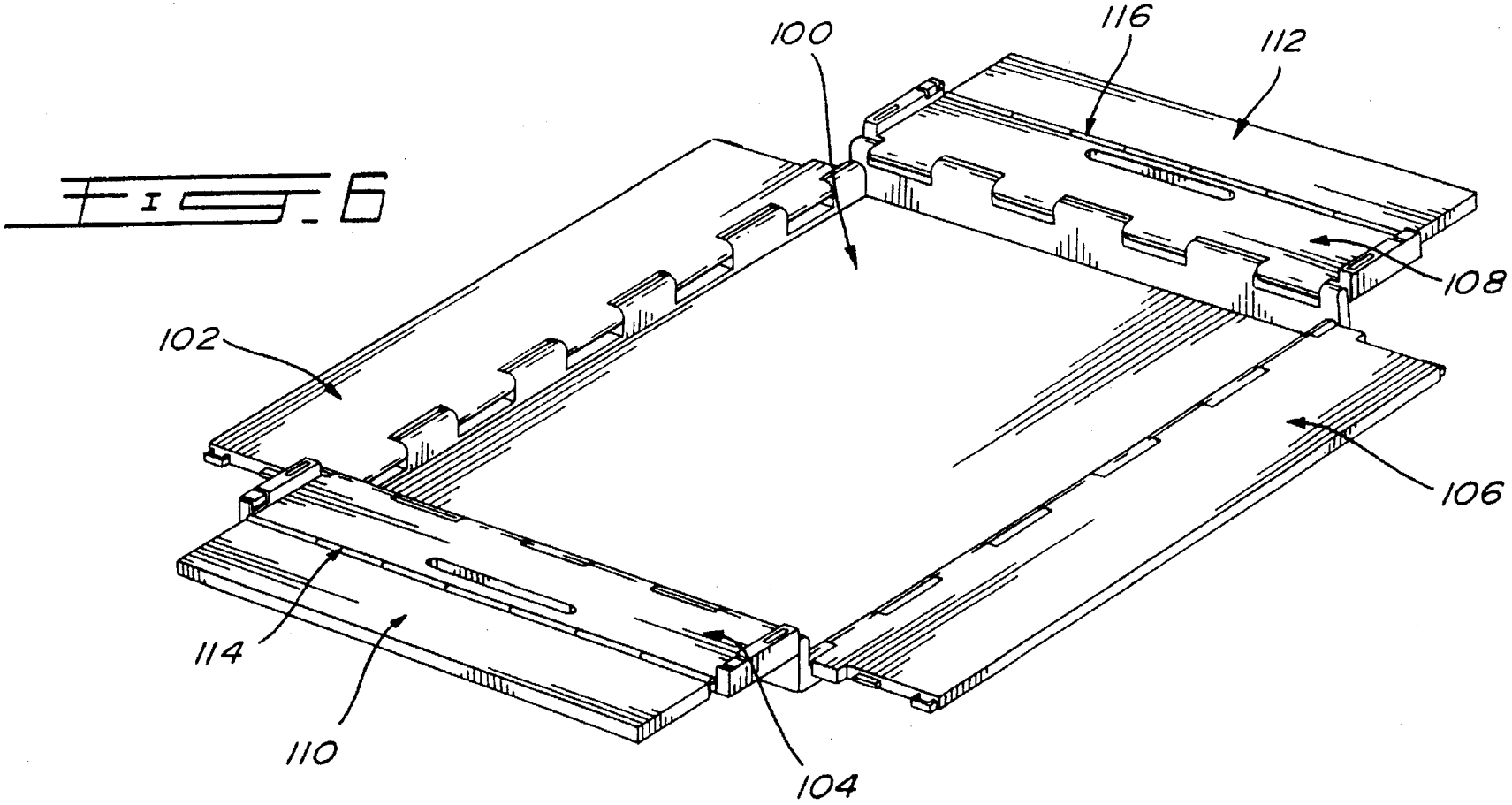
FIGS. 6 is a schematical representation of a seven-piece container shown in the outward foldback position.
Figure 7:
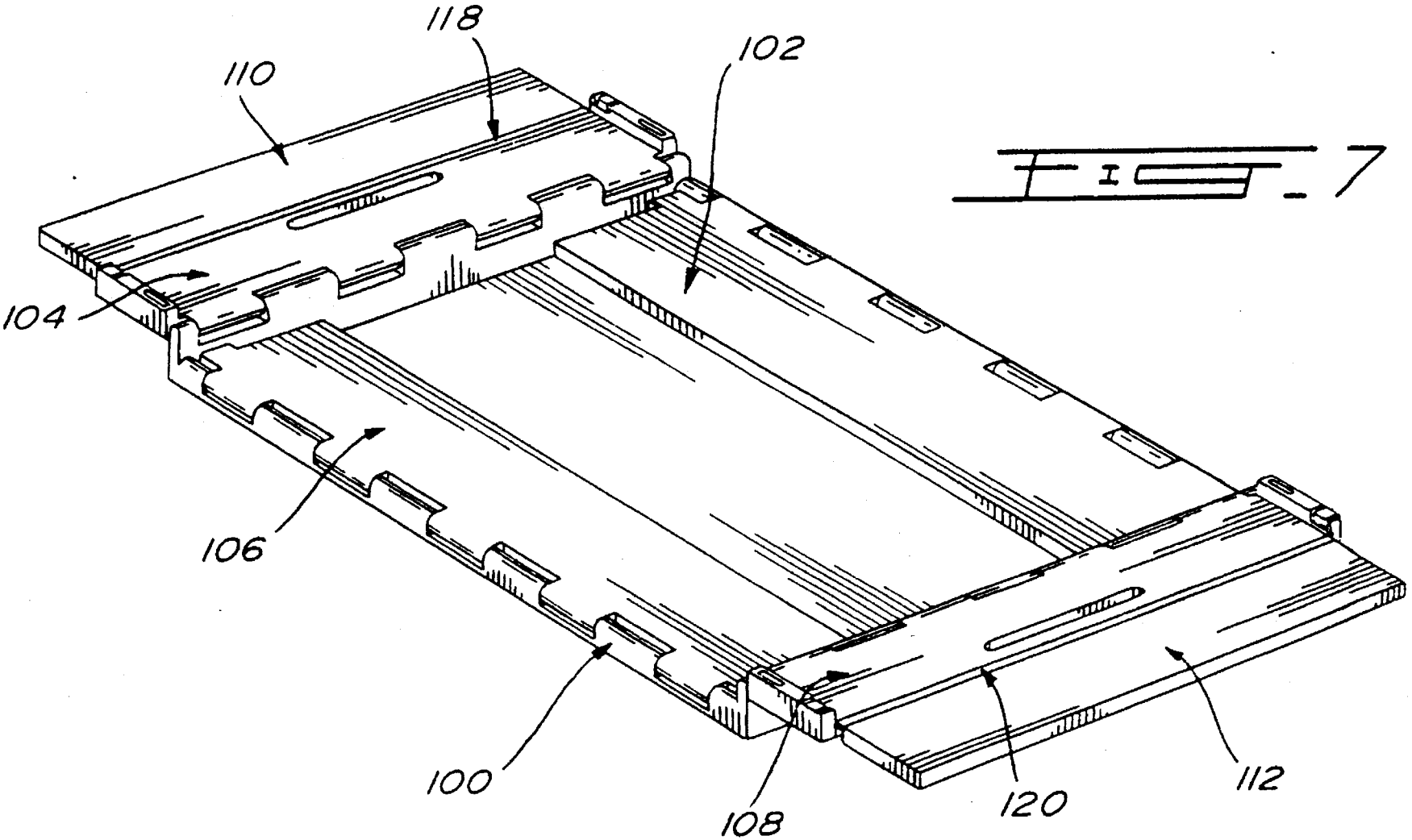
Figure 1:
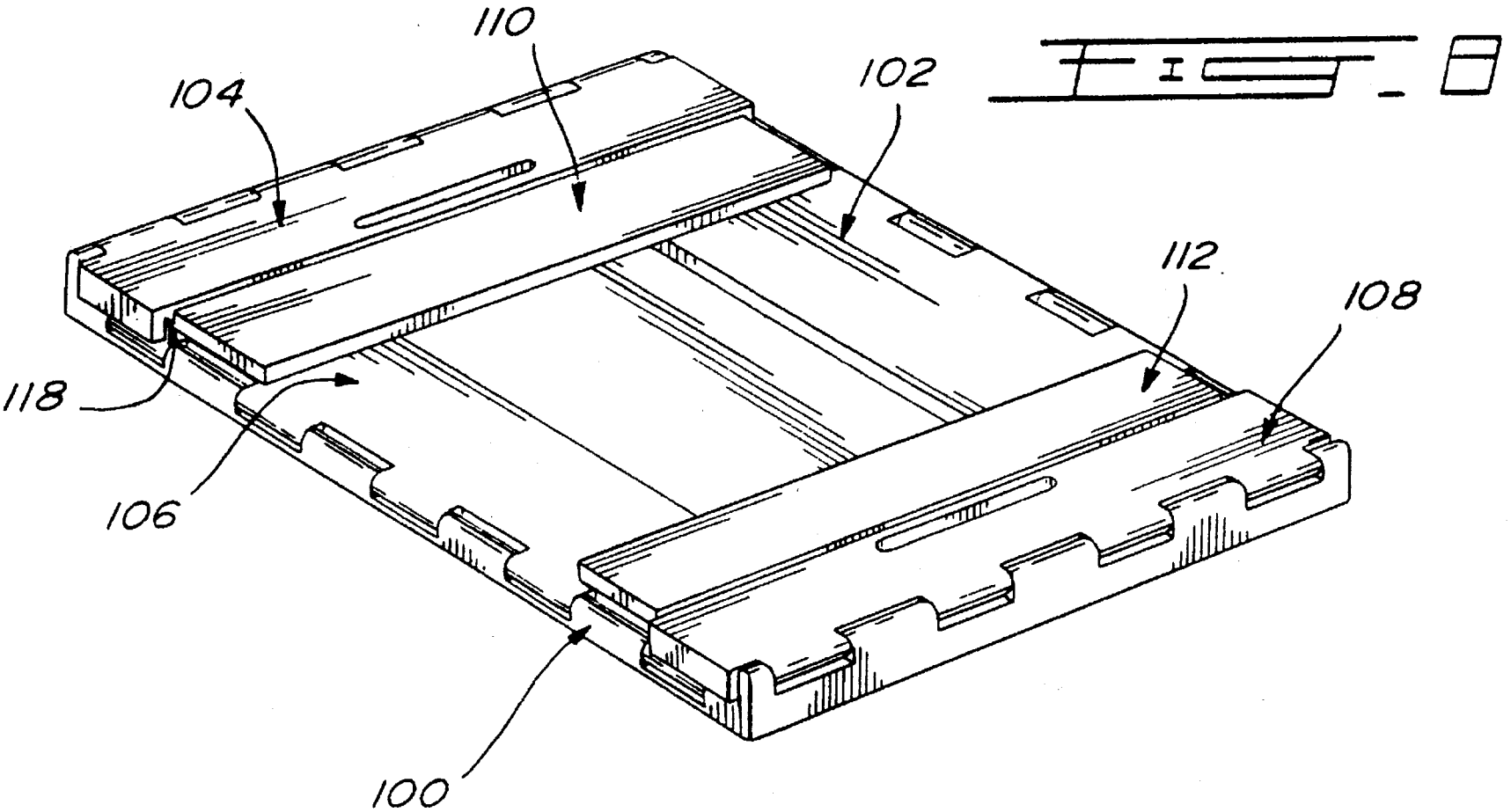

FIGS. 6, 7 and 8 are schematic views of a plastic container consisting of a bottom piece 100, of four side pieces 102, 104, 106 and 108 and of two additional pieces 110 and 112, which are called lid pieces, and which are hingedly connected to two side pieces 104 and 108 respectively.

In one form of the invention (see FIG. 6), the connection (114, 116) between the side piece 104 and the lid piece 110 as well as the connection of the side piece 108 with the lid piece 112 is accomplished through a snap-in engagement which is identical to that described above in FIGS. 1 to 5 and which consists of C-shaped extensions on the side piece engaging hinges integrally formed in recessed areas of the lid piece. In this case, the container is called a seven-piece container.

As an alternative (see FIGS. 7 and 8), the connection (118,120) between the side pieces and the lid pieces may be accomplished through a thin integral connection of reduced cross-section between these pieces. In this case, the container remains a five-piece container with the side pieces being each formed of a pair of foldable sections.

FIG. 7 illustrates how the side pieces and lid pieces are folded in order to reach the inwardly folded position shown in FIG. 8.

Although the invention has been described above with respect with one specific form, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A five-piece container for carrying items, such as fruits and vegetables, comprising:

a bottom piece formed of plastics material, said bottom piece having four side edges; and four side pieces formed of plastics material, each side piece having a lower edge;

each said side edge of said bottom piece including a series of horizontally spaced recessed areas and a horizontally extending integrally formed hinge traversing each said area; each said lower edge of said side pieces including a series of horizontally spaced extensions defining a C-shaped profile; said extensions being so disposed along each said lower edge as to be received within a corresponding one of said recessed areas for assembly of said side piece to said bottom piece; said profiles being configured to enable a snap engagement and disengagement of said extensions with and from said hinges and to allow said side pieces to be moved between an outward foldback position, an erected position and an inwardly folded position.

2. A five-piece container as defined in claim 1, wherein said bottom side edges consist of a first pair of opposite edges and a second pair of opposite edges; the edges of said first pair having a height different from that of the edges of said second pair whereby, in said inwardly folded position, a first pair of opposite side pieces lie in a first plane and a second pair of opposite side pieces lie in a second plane.

3. A five-piece container as defined in claim 1, wherein each said hinge defines a cross-section that includes two orthogonal faces and a semi-circular third face.

4. A five-piece container as defined in claim 3, wherein said orthogonal faces define a pointed edge to frictionally contact an interior wall of said C-shaped profile.

5. A five-piece container as defined in claim 1, wherein each said C-shaped profile includes a longitudinal boss on an exterior wall thereof; said boss being adapted to frictionally contact a portion of said side edges of said bottom member during a folding operation.

6. A five-piece container as defined in claim 1, wherein each said side piece includes opposite lateral edges; said opposite lateral edges of contiguous side pieces having complementary engaging means allowing said side pieces to be connected to one another in the erected position.

7. A five-piece container as defined in claim 6, wherein said engaging means consist of blocks and block receiving slots and flexible tongues and tongue engaging members.

8. A five-piece container as defined in claim 1, wherein two of said four side pieces are each formed of a pair of foldable sections interconnected through a film-like hinge of reduced cross-section; said pair of foldable sections defining a side wall and a lid to said container.

9. A seven-piece container for carrying items, such as fruits and vegetables, comprising:

a bottom piece formed of plastics material, said bottom piece having four side edges;

four side pieces formed of plastics material, each side piece having a lower edge and a top edge;

each said side edge of said bottom piece including a series of horizontally spaced recessed areas and a horizontally extending integrally formed hinge traversing each said area; each said lower edge of said side pieces including a series of horizontally spaced extensions defining a C-shaped profile; said extensions being so disposed along each said lower edge as to be received within a corresponding one of said areas for assembly of said side piece to said bottom piece; said profiles being configured to enable a snap engagement and disengagement of said extension with and from said hinges and to allow said side pieces to be moved between an outward foldback position, an erected position and an inwardly folded position; and an inwardly folded position; and a pair of lid pieces formed of plastics material, each lid piece including four edges; one of said four edges being hingedly connected to said top edge of said side piece; each said one edge of said lid piece including a series of horizontally spaced recessed areas and a horizontally extending integrally formed hinge traversing each said area; each said top edge of said side pieces including a series of horizontally spaced extensions defining a C-shaped profile; said extensions being so disposed along each said top edge as to be received within a corresponding one of said recessed areas for assembly of said side piece to said lid piece; said profiles being configured to enable a snap engagement and disengagement of said extensions with and from said hinges and to allow said lid pieces to be folded relative to said side piece.

* * * * *